United States Patent [19]

Gabelish et al.

[11] Patent Number: 4,597,321

[45] Date of Patent: Jul. 1, 1986

[54] ROTARY VALVE

[76] Inventors: Peter W. Gabelish, 17 Seaview Street, Cronulla, New South Wales 2230; Albany R. Vial, 204 Forest Road, Gymea, New South Wales 2227; Russell W. Roberts, Lot 16 Coast Road, West Swan, Western Australia 6055, all of Australia

[21] Appl. No.: 553,433

[22] Filed: Nov. 18, 1983

[30] Foreign Application Priority Data

Nov. 19, 1982 [AU] Australia ..... PF6890

[51] Int. Cl.[4] ..... F15B 11/08

[52] U.S. Cl. ..... 91/470; 137/625.23; 137/625.24

[58] Field of Search ..... 91/470, 467; 137/625.23, 625.24; 123/190 BD, 190 B, 190 DL, 190 E, 80 BA; 417/519

[56] References Cited

U.S. PATENT DOCUMENTS

| | | | |
|---|---|---|---|
| 985,618 | 2/1911 | Miller | 123/190 BD |
| 1,097,166 | 5/1914 | Calkins et al. | 123/190 BD |
| 1,347,978 | 7/1920 | Wehr | 123/190 BD |
| 1,573,022 | 2/1926 | Wehr | 123/190 BD |
| 1,887,997 | 11/1932 | Cross | 123/190 BD |
| 1,977,025 | 10/1934 | Van der Elst et al. | 123/190 BD |
| 1,997,133 | 4/1935 | Cross | 123/190 BD |
| 2,048,134 | 7/1936 | Montalto | 123/190 BD |
| 2,158,386 | 5/1939 | Sykes | 123/190 BD |
| 2,853,980 | 9/1958 | Zimmerman | 123/80 BA |
| 3,730,161 | 5/1973 | Deane | 123/190 BD |
| 3,871,340 | 3/1975 | Zimmerman | 123/190 BD |
| 3,948,227 | 4/1976 | Guenther | 123/190 BD |
| 3,990,423 | 11/1976 | Cross et al. | 123/190 BD |
| 4,201,174 | 5/1980 | Vallejos | 123/190 B |
| 4,404,934 | 9/1983 | Asaka et al. | 123/190 BD |

OTHER PUBLICATIONS

F. Stronach, "Four-Stroke Break Through", *Revs. Motorcycle News,* vol. 16, No. 6 (Dec. 24, 1982–Jan. 13, 1983), pp. 19–23.

*Primary Examiner*—Edward K. Look

*Attorney, Agent, or Firm*—Ostrolenk, Faber, Gerb & Soffen

[57] ABSTRACT

A rotary valve assembly for an internal combustion engine, the rotary valve assembly has a split housing which provides a cylindrical passage within which a valve rotor is located, surrounding the valve rotor is a sealing sleeve which is biased into sealing contact with the valve rotor by means of the split housing, and the split housing is sealingly connected to a head of an internal combustion engine by means of an annular seal having a V-shaped transverse longitudinal cross section.

13 Claims, 7 Drawing Figures

ROTARY VALVE

BACKGROUND OF THE INVENTION

The present invention relates to valves and more particularly to rotary valves.

Still further the present invention relates to rotary valves for reciprocating heat engines and particularly for internal combustion engine.

With particular reference to valves employed in internal combustion piston engines, known rotary valves have not been widely accepted as they have not provided the advantages of conventional valves in respect of simplicity of construction, cost of manufacture, oil consumption, durability and ruggedness.

A rotary valve arrangement is disclosed in U.S. Pat. No. 985,618 to Miller. The patent to Miller discloses a rotary valve including a valve housing formed integral with the head of the engine and which receives a valve rotor which communicates with the combustion chamber via an annular sealing ring generally coaxial with the port communicating with the combustion chamber. More particularly the patent to Miller relates to this annular sealing member and its configuration whereby under combustion pressures the sealing members is formed into sealing contact with the valve rotor. Rotary valves are also disclosed in U.S. Pat. Nos. 1,347,978 and 1,573,022, both to Wehr. The earlier patent to Wehr discloses a rotary valve assembly having a split housing to support a bush having a cylindrical inner surface to receive the valve rotor. This sleeve has a cylindrical outer surface eccentric with respect to the inner surface. The valve rotor communicates with the combustion chamber by means of a port extending through the sleeve and part of the housing. It should be particularly noted that the split housing is mounted on the cylinder and forms the head of the engine. The second patent to Wehr is a modification of the device disclosed in his earlier patent, and more particularly describes a means of biasing the sleeve into sealing contact with the valve rotor. The U.S. Pat. No. 1,887,997 to Cross, also relates to a rotary valve arrangement and in particular relates to an annular sealing element which surrounds the port exiting from the combustion chamber and which sealingly engages the valve rotor. This annular sealing member is generally coaxial with the port extending from the combustion chamber. U.S. Pat. No. 2,048,134, describes a rotary valve arrangement with the rotor being supported by a housing consisting of two portions which are spring biased together so as to engage the valve rotor. An annular sealing element surrounds the port exiting from the combustion chamber and also sealingly engages the valve rotor. U.S. Pat. No. 1,997,133, to Cross, is an improvement on Cross's earlier Pat. No. 1,887,997, and particularly relates to the annular sealing element surrounding the port exiting from the combustion chamber and sealingly engaging the rotor. It is again pointed out that this annular sealing element is generally coaxial with the port exiting from the combustion chamber. U.S. Pat. No. 2,158,386, describes a rotary valve arrangement having a hollow housing within which is received a sleeve 25 supported in a spaced relationship relative to the housing. The sleeve defines a cylindrical passage which receives the valve rotor and the sleeve is attached to the cylinder head. More particularly this patent describes a method of constructing the sleeve particularly when the sleeve is constructed of two parts whereby the two parts are resiliently biased together by means of springs. U.S. Pat. Nos. 2,853,980 and 3,871,340, to Zimmerman, describe a rotary valve arrangement with the head of the engine having a cylindrical passage to receive the valve rotor, formed integral with the head is a resilient support for the rotor and the arrangement further includes an annular sealing element which surrounds the port communicating with the combustion chamber. This annular sealing element is generally coaxial with the port and engages the valve rotor. U.S. Pat. No. 3,990,423, to Cross, describes a rotary valve arrangement with the valve rotor supported in a two part housing with one of the housing parts forming the cylinder of the engine. The two part housing is biased together by means of a spring arrangement with the valve rotor communicating with the combustion chamber by means of a port. An annular sealing element is located around the port and sealingly engages the valve rotor. These known rotary valves have suffered from the drawbacks of most rotary valves in that they are generally costly to manufacture and lack durability and ruggedness and in particular consume excessive amounts of oil or require external oil control methods by reason of the fact that oil used in lubricating the valve rotor is relatively free to enter the combustion chamber of the engine.

SUMMARY OF THE INVENTION

It is an object of the present invention to overcome or substantially ameliorate the above disadvantages.

The present invention consists of a rotary valve mechanism for a reciprocating heat engine having a cylinder, a piston reciprocating therein and a cylinder head defining a combustion chamber, the rotary valve mechanism consisting of a generally cylindrical valve rotor supported for rotation in said cylinder head, the valve rotor having at least one gas port passing through its cylindrical surface, mechanical means to rotate the valve rotor in a timed relationship with the movement of the piston, a floating seal assembly in said cylinder head having a cylindrical inner surface of the valve rotor, said floating seal assembly being free to thrust against the surface of the valve rotor under the influence of the pressure of the working gases in the combustion chamber, the floating seal assembly defining a gas conducting port arranged to provide communication between the gas port in the valve rotor and the combustion chamber, the cylindrical sliding, sealing contact surfaces of the valve rotor and the floating seal assembly being divided into three axially adjacent cylindrical zones comprising one inner sealing zone and two outer thrust carrying zones, the said inner sealing zone being of such axial length to include fully the cylindrical path swept by the gas port in the cylindrical surface of the valve rotor as the valve rotor rotates, the two outer thrust carrying zones being arranged one on either side of the inner sealing zone, means to supply a liquid lubricant to the outer thrust carrying zones and means to restrain said lubricant from passing axially from the outer thrust carrying zones into the inner sealing zone.

A preferred form of the present invention will now be described by way of example with reference to the accompanying drawings, wherein:

DESCRIPTION OF THE PREFERRED EMBODIMENTS

In the following preferred embodiment of the present invention, an improved rotary valve is provided which results from the realization that many of the disadvantages of prior rotary valves, as described previously, can be overcome by providing a two part seal arrangement to sealingly connect the rotor with the head or block of an engine. In the present instance a first sealing device is employed to engage the rotor and then a resilient seal is used to connect the sealing device with the head or block of the engine. This allows movement of the valve rotor while still maintaining sealing contact therewith. A particular advantage of such a combination is that it is considerably less complex than previous valve assemblies.

Figure 1:
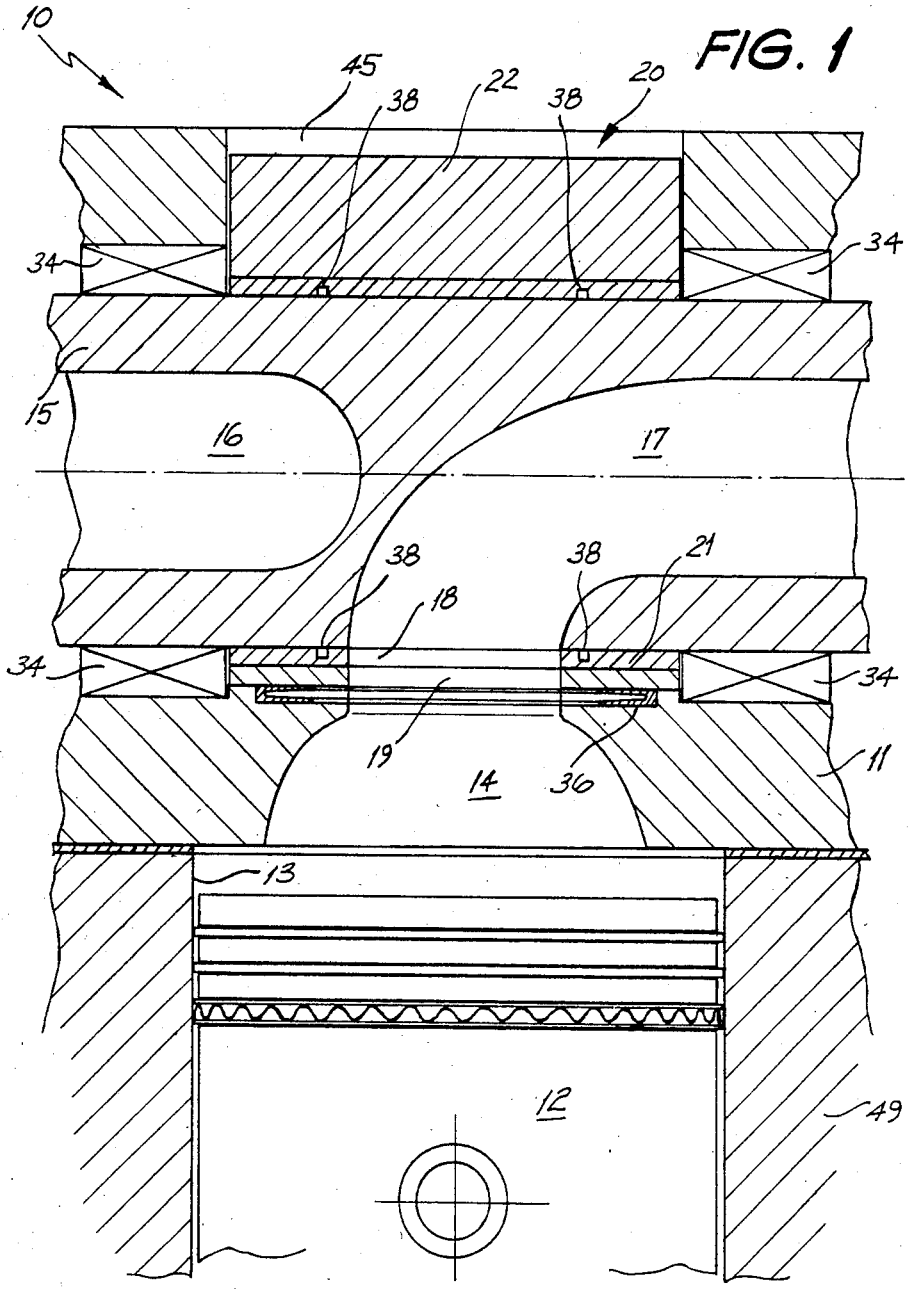
FIG. 1 is a schematic sectioned side elevation of a rotor valve assembly in association with a combustion chamber of an internal combustion engine.
Figure 2:
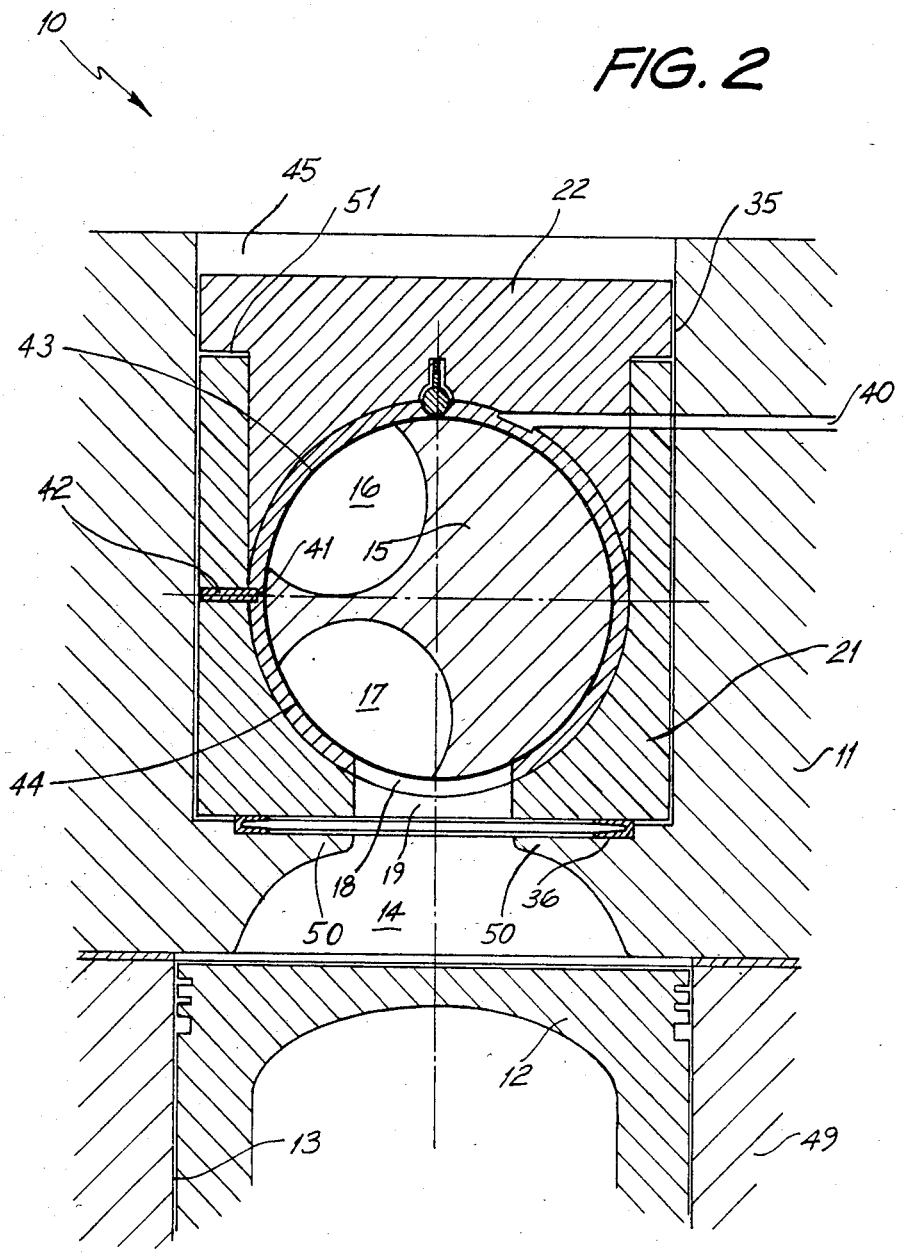
FIG. 2 is a schematic sectioned end elevation of the valve assembly of FIG. 1.
Figure 3:
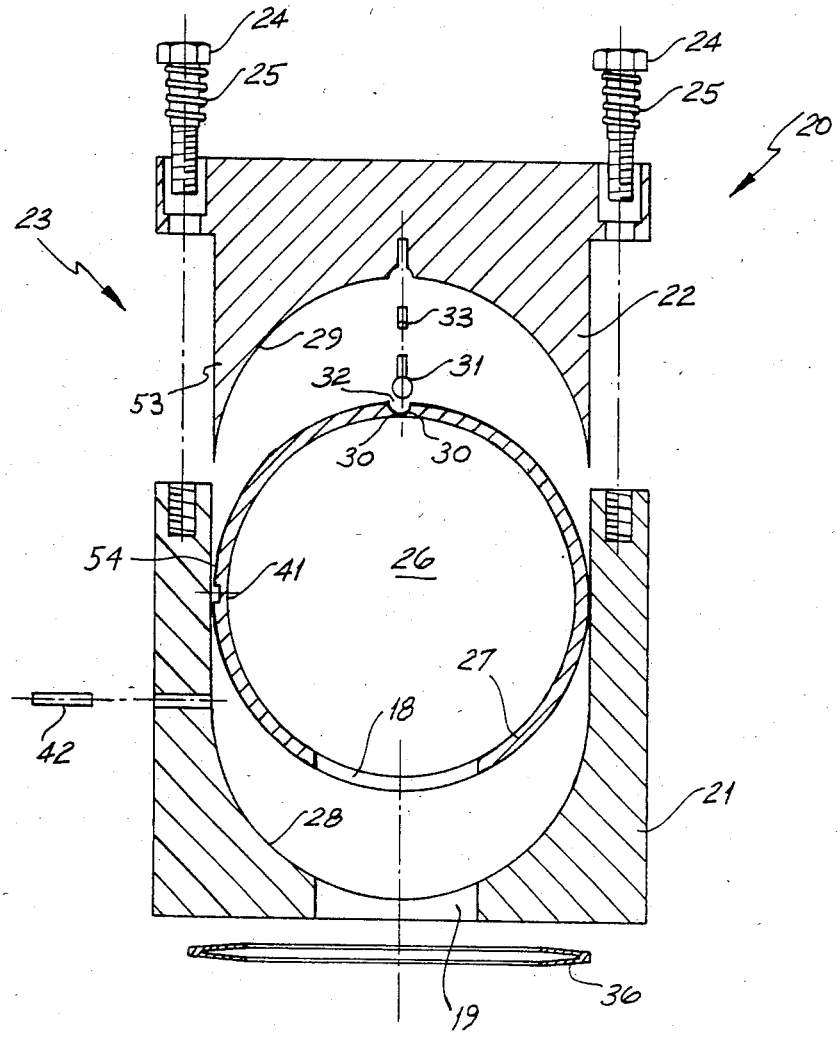
FIG. 3 is a schematic parts exploded sectioned end elevation of the seal assembly for the valve rotor of the valve of FIG. 1.

In FIGS. 1 to 3 there is schematically depicted a rotary valve assembly 10 in association with a cylinder head 11 mounted on an engine block 49. The head 11, in combination with a co-operating piston 12 and cylinder 13, defines a combustion chamber 14. The rotary valve assembly 10 includes a rotor 15 which includes longitudinally extending passages 16 and 17 which terminate on the longitudinal periphery surface of the rotor 15 so as to provide two rotor ports 43 and 44. The rotor ports 43 and 44 are angularly spaced about the longitudinal axis of the rotor 15 so as to alternately communicate with a head port 19 extending from the chamber 14. The passages 16 and 17 control the flow of fuel to, and the flow of expended exhaust gases from, the combustion chamber 14.

In operation of the valve assembly 10, the rotor 15 is rotated about its longitudinal axis so that the passages 16 and 17 are alternately brought into communication with the combustion chamber 14 in a timed sequence with movement of the piston 12.

The assembly 10 further includes a sealing combination 20 illustrated in FIG. 3 in a parts exploded end elevation. The sealing combination 20 includes a split housing 23 consisting of a bottom member 21 which co-operates with a top member 22 to define a generally circular cavity 26 which rotatably receives the generally cylindrical rotor 15. The members 21 and 22 also co-operate to define a cube and have their end faces spaced by a gap 51. The split housing 23 further includes bolts 24; which in combination with springs 25 secure the two support members 21 and 22 together and bias them toward the rotor 15. The member 21 is formed with the port 19 extending from the chamber 14. Located within the circular cavity 26 is a split generally cylindrical hollow rotor seal 27 in the form of a sleeve which is supported on the generally cylindrical surfaces 28 and 29 of the members 21 and 22. As the two members 21 and 22 are urged together by means of the springs 25, the seal 27 is biased to define a generally cylindrical configuration conforming to the outer cylindrical surface of the rotor 15. The seal assembly 20 acts as a seal in retaining the combustion gases within the chamber 14.

Figure 5:
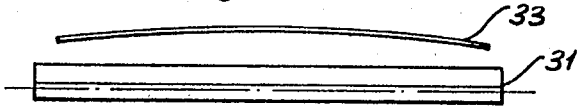
FIG. 5 is a schematic side elevation of a seal assembly used in the assembly of FIG. 1.
Figure 7:
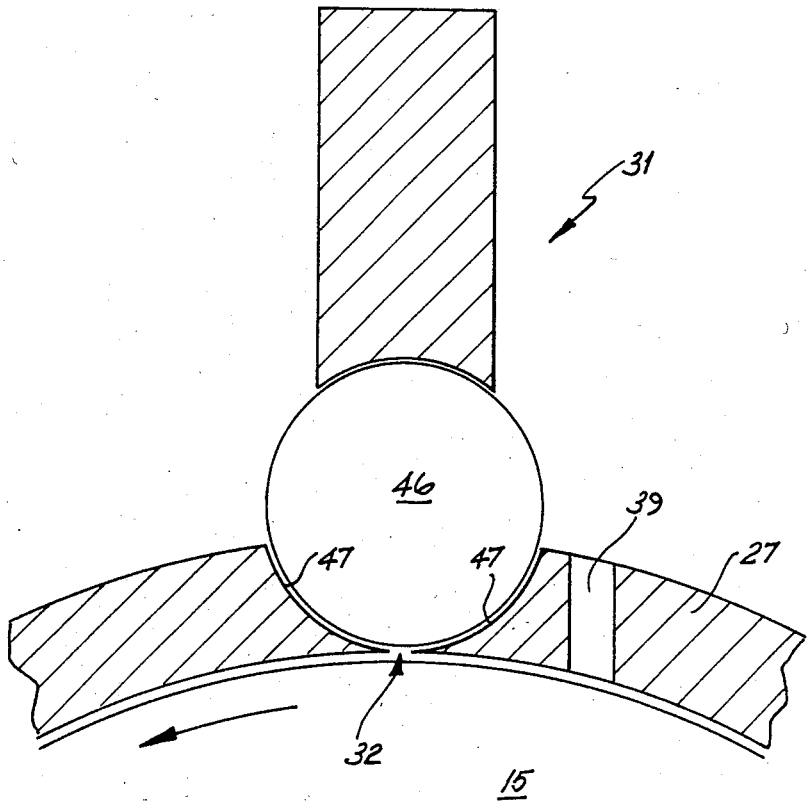
FIG. 7 is a schematic sectioned side elevation of a portion of the assembly of the seal of FIG. 5.

The extremities 30 of the seal 27 co-operate to define a generally arcuate shaped groove 32 within which is located a sealing strip 31 which is made of generally pliable material such as an elastomer so as to conform to its surrounding surfaces to prevent oil travelling along the groove 32. The strip 31, which is also depicted in FIGS. 5 and 7, is biased to engagement within the groove 32 by means of a resilient leaf-type spring 33 also depicted in FIG. 5. However, the spring 33 could also take the form of coil springs. The split seal 27, in combination with the spring-loaded housing 23 and with the sealing strip 31, enable the rotor 15 to be constructed of different material to that of the supporting and sealing combination 20 by compensating for different thermal expansion rates of the materials employed. Additionally the split seal 27 in combination with the spring-loaded housing 23 compensates for the variation in expansion of the rotor 15 and of the seal assembly 20 due to changing the temperature conditions to which the valve assembly 10 is subjected to. With particular reference to FIG. 7 it can be seen that the sealing strip 31 has a end 46 of circular cross section and which is the pliable portion of the strip 31 which sealingly slidingly engages the surfaces 47 of the groove 32. As the seal 27 expands and contracts due to changing temperature conditions within the engine, the end 46 will compensate for movement between the surfaces 47. Additionally the sealing strip 31 slidingly engages the rotor 15 and acts to prevent oil passing the sealing strip 31. The strip 31 also forces oil through the passages 39, which drain oil from the grooves 38, by acting as a dam.

The rotor 15 is supported by means of bearings 34 while the seal 27 sealingly engages the external surface of the rotor 15. Accordingly the seal 27 provides an effective seal about the rotor 15 to inhibit the flow of oil to the combustion chamber 14 and the flow of gases through the valve assembly 10 other than that permitted to exit or enter by means of the passages 16 and 17. This is achieved by pressure being applied to the surfaces of the valve rotor 15 and the inner surface of the seal 27 in the area adjacent the port 19. This pressure is applied firstly to the flat surface 48 of the bottom member 21 and is transmitted to its inner surface 28 and then to the outer surface of seal 27.

Figure 4:
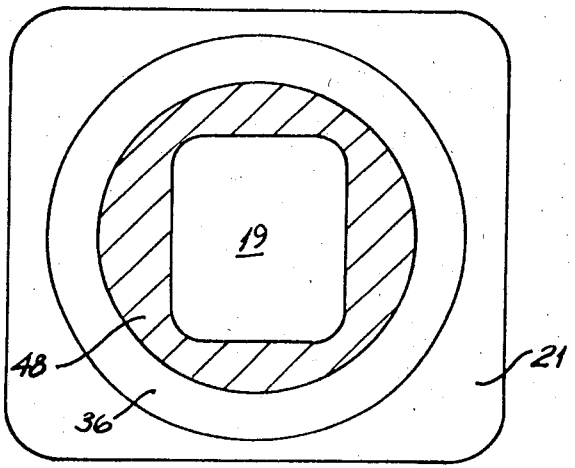
FIG. 4 is a schematic bottom plan view of the assembly of FIG. 3 as seen from the combustion chamber.

The pressure which is largely proportional to the pressure of gas in the combustion chamber 14 is created by;

(a) the force transmitted through the lower part of the member 21, arising from combustion pressure acting on area 48 (see FIG. 4), (b) deformation of the resilient seal 36, and (c) the preload forces applied by the springs 25.

The split housing 23 is located in a cavity 45 provided in the head 11 and extending from the combustion chamber 14. The split housing has a clearance 35 around its periphery to enable self alignment and movement of the sealing combination 20 relative to the head 11. The split housing 23 is sealingly engaged with the head 11 by means of a resilient seal 36 which has flexible flanges so as to generally define a V-shape configuration in transverse longitudinal cross section. The resilient seal 36 permits rocking movement of the members 21 and 22 while still retaining sealing contact between the head 11 and member 21 and clearance variations due to thermal expansion.

In use the seal 36 is resiliently deformed as that the flanges are biased to engage the head 11 and bottom member 21. Under high pressure conditions the flanges are forced outwardly to further enhance sealing contact with the head 11 and member 21. Preferably the seal 36 would be machined from a single piece of high temperature alloy steel with the flanges tapering toward their inner extremities. By providing a seal 36 of relatively small diameter, between the head 11 and the bottom support member 21, the force applied to the rotor 15 by the combustion gases can be reduced by reduction of the area 48, of the member 21, exposed to the combustion chamber 14.

Figure 6:
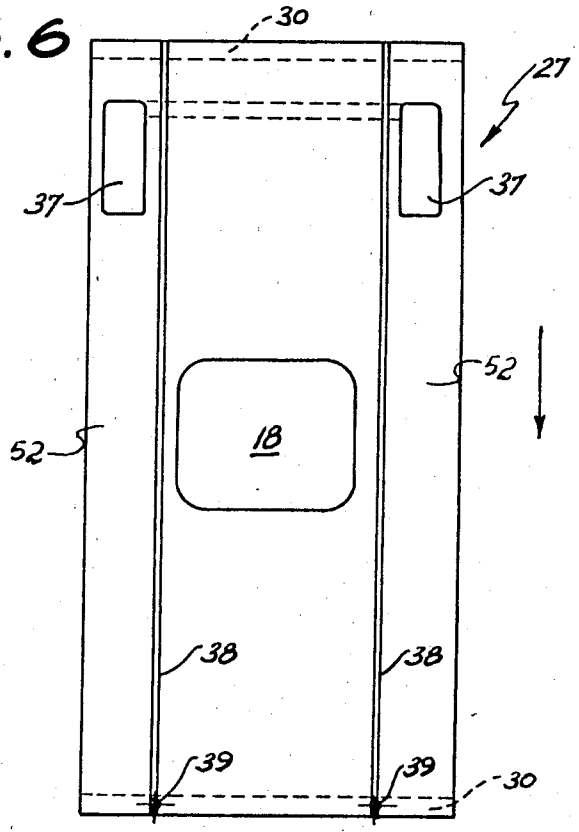
FIG. 6 is a schematically developed plan view for the split seal used in the seal assembly of FIG. 3.

Now with reference also to FIG. 6 wherein the split seal 27 is illustrated in plan view, with the seal 27 flattened for ease of description. The seal 27 includes two oil ports 37 which deliver oil to the load bearing surfaces of the seal 27. Defined in the seal 27 is a passage 18 which provides for communication between the combustion chamber 14 and the passages 16 and 17. Additionally the seal 27 is provided with two oil control grooves 38 which inhibit the transfer of oil from lubricated load bearing areas 52 to an area of the seal 27 which will be exposed to the combustion chamber 14, or ports 16 and 17. The seal 27 also provides two load bearing areas 52 to support the split housing 23 and retains it in position.

Communicating with the oil control grooves 38 are passages 39 which provide for the draining of oil from the grooves 38. Oil is delivered to the ports 37 by means of an oil gallery 40 which is depicted in FIG. 2. Additionally the seal 27 would be provided with a location indentation 41 which receives a location peg 42 to prevent rotation of the seal 27.

It should be appreciated that the oil control grooves 38 act as a barrier between the lubricated load bearing areas 52 and the areas exposed to the passages 16 and 17 and the port 19. More particularly side leakage from the hydrodynamically lubricated areas 52 enters the oil control grooves 38 and is carried by rotation of the rotor 15 to drainage passage 39.

Cooling of the rotary valve 10 may be achieved by a water jacket which permits the flow of water past the rotary valve assembly 10, and more particularly past the sides of the split housing 23.

To prevent the escape of water from the water jacket there would be provided seals which sealingly contact the external surface of the split housing 23. This particular cooling system would enable the rapid distribution and extraction of heat from the rotary valve assembly 10.

Cooling of the rotary valve assembly 10 may also be achieved by a plurality of fins which dissipate heat by means of radiation and conduction to the surrounding air medium.

Again this particular system provides for the rapid dissipation of heat from the rotary valve assembly 10. More particularly the fins would be formed integral with the support member 22, however member 21 could also be provided with fins.

It should be appreciated that heat conduction from the rotor 15 is enhanced by the area of contact between the seal 27 and the rotor 15, and in turn the area of contact between the seal 27 and the support members 21 and 22 and the cube shape of the sealing combination 20. The heat transfer between members 21 and 22 is enhanced by the large area of contact and contact pressure between the two members 21 and 22. This contact force results from transverse pressure between the vertical abutting sides of the seal members 21 and 22. Additionally as the area 48 of the sealing combination 20 exposed to the combustion chamber 14 is minimized, so too is the heat absorbed by the seal combination 20 due to its exposure to the heat within the combustion chamber 14. The area 48 is reduced by providing the heat 11 with flange portions 50 which project radially inwardly above the cylinder 13. Heat absorption into sealing combination 20 is further reduced by minimising the length of port 19 in bottom member 21. Shortening of port 19 is made possible by split housing construction of seal assembly 20 in combination with resilient seal 36. To aid in heat transfer, the members 21 and 22 have elongated sides 53 and 54 to increase the area of contact between the members 21 and 22. What we claim is:

1. A rotary valve mechanism for a reciprocating heat engine, the engine having a cylinder, a piston reciprocally movable in the cylinder, and a cylinder head defining a combustion chamber communicating with the cylinder, the cylinder head having a cavity and a port opening defined therein, the cavity communicating with the combustion chamber at the port opening, the rotary valve mechanism comprising:

a valve housing in the cavity; means for permitting movement of the valve housing within the cavity relative to the cylinder head under the influence of gas pressure upon the housing; means in the housing for providing a generally cylindrical inner surface defining a generally circular cavity therein, the housing further having a gas port defined therein for communicating between the port opening in the cylinder head and the circular cavity;

a cylindrical valve rotor rotatably supported in the circular cavity defined in the housing and having a generally cylindrical outer surface in sliding sealing contact with the inner surface provided in the housing, the valve rotor having two rotor ports defined in the outer surface thereof for alternately and periodically communicating with the gas port as the valve rotor rotates; and mechanical means for rotating the valve rotor in a timed relationship with the movement of the piston;

the valve housing further having a pressure receiving surface disposed toward the port opening in the cylinder head for receiving pressure from working gas in the combustion chamber, the movement permitting means permitting the housing to move under the influence of the gas pressure for applying the received pressure to the outer surface of the valve rotor through the inner surface provided in the housing for providing an effective seal;

the inner and outer surfaces each having three axially adjacent cylindrical zones including an inner exposed zone which is axially between two outer load-bearing zones, the exposed zone including totally within its axial length the gas port as the valve rotor rotates;

the load bearing zones supporting thrust, due to gas pressure, between the inner and outer surfaces;

the valve mechanism further comprising means for delivering lubricant to the load-bearing zones and means between the load-bearing zones and the exposed zone for inhibiting the lubricant from flowing from the load-bearing zones to the exposed zone.

2. A rotary valve mechanism as set forth in claim 1, in which the means for inhibiting lubricant flow comprise circular grooves in the cylindrical inner surface provided in the valve housing for separating the outer load-bearing zones from the inner exposed zone, a respective fixed dam blocking each of the grooves, a respective drainage passage communicating with each of the grooves to convey away from the grooves lubricant which has circulated through the outer load-bearing zones to the grooves, the dams being so positioned with respect to the respective drainage passages that lubricant entering the grooves is carried by rotation of the valve rotor to the dams which divert the lubricant into the drainage passages.

3. A rotary valve mechanism as set forth in claim 1, in which the valve housing comprises a first housing member and a second housing member; the means for providing the inner surface being a cylindrical sleeve, the first and second housing members each having an interior surface, the interior surfaces of the housing members defining a generally cylindrical surface supporting the cylindrical sleeve, the cylindrical sleeve receiving the valve rotor within the sleeve.

4. A rotary valve mechanism as set forth in claim 3, in which the cylindrical sleeve is broken by a longitudinal split to accommodate changes in its circumferential dimension, the means for inhibiting lubricant flow comprising two axially spaced apart, circumferential grooves extending around the interior surface of the cylindrical sleeve respectively at the junctions of the outer load-bearing zones with the inner exposed zone, lubricant ports in the cylindrical sleeve for feeding lubricant to the load-bearing zones, damming means, located in the split, for interrupting the grooves, and lubrication drainage passages disposed adjacent to the damming means and on the upstream side thereof and extending from the grooves for conveying lubricant away from the rotor.

5. A rotary valve mechanism as set forth in claim 4, in which the sleeve has bordering edges which border the longitudinal split, the bordering edges being tapered from the outer diameter of the sleeve to the inner diameter to form a straight external groove disposed about the split, the damming means comprising a pliable sealing strip which extends along the length of the straight groove, spring means for forcing the sealing strip into the straight groove to sealingly engage the surfaces of the straight groove along respective lines of contact and to sealingly engage that portion of the valve rotor outer surface which is then exposed between the bordering edges, the volume defined between the lines of contact of said pliable sealing strip with the sides of the straight groove and the exposed outer surface of the rotor being completely filled by the pliable sealing strip.

6. A rotary valve mechanism as set forth in claim 5, in which the tapered edges of the sleeve bordering the split are each of curved concave shape when viewed in end elevation, the sealing strip is made of a heat resistant elastomeric material and has a sealing portion, for engaging the tapered edges of the sleeve, which is of generally circular cross-section; rigid force transmitting means located between the spring means and the sealing portion of the sealing strip for ensuring even contact pressure distribution along the length of the sealing strip.

7. A rotary valve mechanism as set forth in claim 4, in which one of the valve housing members is fitted slidingly within the other housing member, and both housing members have large parallel contiguous surfaces able to slide over one another while remaining in thermal contact so that the members can have relative movement to one another to accommodate the thermal expansion differential between the valve rotor and the valve housing assembly without loss of thermal conduction between the housing members.

8. A rotary valve mechanism as set forth in claim 7, in which the valve housing is of cubical shape and the contiguous sliding surfaces of the members extend parallel to one pair of opposite sides of the cubical shape.

9. A rotary valve mechanism as set forth in claim 1, further including a single piece resilient, annular seal having flanges defining a substantially V-shape in transverse cross-section, the annular seal extending around the port opening and being interposed between the valve housing and the cylinder head, the flanges projecting radially inward from the base of the V-shape.

10. A rotary valve mechanism for a reciprocating heat engine having a cylinder, a piston reciprocally movable in the cylinder and a cylinder head defining a combustion chamber communicating with the cylinder, the cylinder head having a cavity and a port opening defined therein, the cavity communicating with the combustion chamber at the port opening, the rotary valve mechanism comprising:

a valve housing in the cavity; means for permitting movement of the valve housing within the cavity relative to the head under the influence of gas pressure upon the housing; means in the housing for providing a generally cylindrical inner surface defining a generally circular cavity therein, the housing further having a gas port defined therein for communicating between the port opening in the cylinder head and the circular cavity;

a cylindrical valve rotor rotatably supported in the circular cavity defined in the housing and having a generally cylindrical outer surface in sliding sealing contact with the inner surface provided in the housing, the valve rotor having two rotor ports defined in the outer surface thereof for alternately periodically communicating with the gas port as the valve rotor rotates; and mechanical means for rotating the valve rotor in a timed relationship with the movement of the piston;

the valve housing further having a pressure receiving surface disposed toward the port opening in the cylinder head for receiving pressure from working gas in the combustion chamber, the movement permitting means permitting the housing to move under the influence of the gas pressure for applying the received pressure to the outer surface of the valve rotor through the inner surface provided in the housing for providing an effective seal;

the cylinder head further having a sealing surface defined thereon around the port opening and disposed toward the pressure receiving surface of the housing;

the valve mechanism further comprising a single-piece resilient, annular seal having flanges defining a substantially V-shape in transverse cross-section, the annular seal being between the pressure receiving surface of the housing and the sealing surface of the cylinder head and extending around the port opening, the flanges projecting radially inward from the base of the V-shape.

11. A rotary valve mechanism as claimed in claim 10, in which the annular sealing ring comprises a machined, single-piece of high temperature alloy steel, the flanges tapering toward their inner circumference.

12. A rotary valve mechanism for a reciprocating heat engine having a cylinder, a piston reciprocally movable in the cylinder and a cylinder head defining a combustion chamber communicating with the cylinder, the cylinder head having a cavity and a port opening defined therein, the cavity communicating with the combustion chamber at the port opening, the rotary valve mechanism comprising:

a valve housing in the cavity; means for permitting movement of the valve housing within the cavity relative to the cylinder head under the influence of gas pressure on the housing; means in the housing for providing a generally cylindrical inner surface defining a generally circular cavity therein, the housing further having a gas port defined therein for communicating between the port opening in the cylinder head and the circular cavity;

a cylindrical valve rotor rotatably supported in the circular cavity defined in the housing and having a generally cylindrical outer surface in sliding sealing contact with the inner surface provided in the housing, the valve rotor having two rotor ports defined in the outer surface thereof for alternately periodically communicating with the gas port as the valve rotor rotates;

mechanical means for rotating the valve rotor in a timed relationship with the movement of the piston;

the valve housing further having a pressure receiving surface disposed toward the port opening in the cylinder head for receiving pressure from working gas in the combustion chamber, the housing applying the received pressure to the outer surface of the valve rotor through the inner surface provided in the housing for providing an effective seal.

13. A rotary valve mechanism as claimed in claim 12, in which the cylinder head further has a sealing surface defined thereon around the port opening and disposed toward the pressure receiving surface of the housing; the mechanism further comprising an annular seal between the pressure receiving surface of the cylinder head and extending around the port opening for permitting movement of the housing while maintaining sealing contact with the cylinder head and the housing.

* * * * *